US010431175B2

(12) United States Patent
Choi

(10) Patent No.: US 10,431,175 B2
(45) Date of Patent: Oct. 1, 2019

(54) GATE DRIVER AND CONTROL METHOD THEREOF

(71) Applicant: SILICON WORKS CO., LTD., Daejeon-si (KR)

(72) Inventor: Jeung Hie Choi, Cheongju-si (KR)

(73) Assignee: SILICON WORKS CO., LTD. (KR)

( * ) Notice: Subject to any disclaimer, the term of this patent is extended or adjusted under 35 U.S.C. 154(b) by 0 days.

(21) Appl. No.: 15/668,245

(22) Filed: Aug. 3, 2017

(65) Prior Publication Data

US 2017/0330525 A1 Nov. 16, 2017

Related U.S. Application Data

(62) Division of application No. 14/585,342, filed on Dec. 30, 2014, now abandoned.

(30) Foreign Application Priority Data

Dec. 30, 2013 (KR) ..... 10-2013-0167229

(51) Int. Cl.
*G09G 3/36* (2006.01)
*G09G 3/20* (2006.01)

(52) U.S. Cl.
CPC ..... *G09G 3/3674* (2013.01); *G09G 3/2092* (2013.01); *G09G 3/3677* (2013.01); *G09G 2310/0286* (2013.01); *G09G 2310/0289* (2013.01); *G09G 2310/06* (2013.01); *G09G 2310/061* (2013.01); *G09G 2310/08* (2013.01); *G09G 2330/027* (2013.01)

(58) Field of Classification Search
None
See application file for complete search history.

(56) References Cited

U.S. PATENT DOCUMENTS 7,736,269 B2 * 6/2010 Long ..... F16H 61/0206 192/3.54
2002/0158275 A1 * 10/2002 Choi ..... G11C 5/143 257/226
2008/0049000 A1 * 2/2008 Kim ..... G09G 3/3677 345/204
2008/0150860 A1 * 6/2008 Hong ..... G09G 3/3677 345/87
2011/0102416 A1 * 5/2011 Hung ..... G09G 3/3677 345/213
2011/0157132 A1 * 6/2011 Byun ..... G09G 3/3677 345/211
2011/0169796 A1 * 7/2011 Guo ..... G09G 3/3677 345/208
2011/0254825 A1 * 10/2011 Peng ..... G09G 3/3648 345/212
2012/0242639 A1 * 9/2012 Lee ..... G09G 3/003 345/211
2013/0088470 A1 * 4/2013 Chang ..... G09G 3/3655 345/208

(Continued)

*Primary Examiner* — Kenneth Bukowski
(74) *Attorney, Agent, or Firm* — Polsinelli PC

(57) ABSTRACT

Provided are a gate driver and a control method thereof. The gate driver receives a power down control signal corresponding to a power down mode, controls an operation of a gate signal processor using the power down control signal which is activated in response to the power down mode, and provides a gate high voltage or gate low voltage for a display panel in response to the power down control signal.

14 Claims, 9 Drawing Sheets

(56) References Cited

U.S. PATENT DOCUMENTS

| | | | | |
|---|---|---|---|---|
| 2013/0235003 | A1* | 9/2013 | Chang | G09G 3/3677 345/204 |
| 2014/0306948 | A1* | 10/2014 | Iwamoto | G09G 3/3648 345/213 |
| 2015/0187314 | A1* | 7/2015 | Choi | G09G 3/3677 345/99 |

* cited by examiner

GATE DRIVER AND CONTROL METHOD THEREOF

CROSS REFERENCE TO RELATED APPLICATIONS

This application is a divisional application of U.S. patent application Ser. No. 14/585,342, filed on Dec. 30, 2014 (currently pending), the disclosure of which is herein incorporated by reference in its entirety. The U.S. patent application Ser. No. 14/585,342 claims priority to Korean Application No. 10-2013-0167229 filed on Dec. 30, 2013, the entire contents of which are incorporated herein by reference.

BACKGROUND

1. Technical Field

The present disclosure relates to a flat panel display device, and more particularly, to a gate driver which improves an operation of providing a gate driving signal to a display panel in response to a power down mode, and a control method thereof.

2. Related Art

Recently, flat panel display devices have been widely spread, and examples of the flat panel display may include a liquid crystal display (LCD) device, a light emitting diode (LED) display device, an organic LED (OLED) display device and the like.

Representatively, the LCD device includes a liquid crystal panel and a driving circuit for driving the liquid crystal panel. The liquid crystal panel includes a plurality of gate lines and source lines intersecting each other, and pixels are defined at the respective intersections between the gate lines and the source lines. Each of the pixels is configured to switch a thin film transistor according to a gate pulse transmitted through a gate line, and display an image according to a source signal transmitted through a source line and the thin film transistor.

The driving circuit includes a source driver for providing a source driving signal to the source line, a gate driver for providing a gate driving signal to the gate line, and a timing controller for controlling the operations of the source driver and the gate driver. Furthermore, the driving circuit includes a voltage supply circuit configured to provide a voltage to the source driver, the gate driver, and the timing controller. The source driver and the gate driver may be implemented with an integrated circuit (IC).

In general, the LCD device has a function of temporarily displaying the entire screen in black or white in order to prevent the degradation of image quality in case of a power down mode in which the system is powered off.

In the above-described power down mode, the gate driver as well as the timing controller may be powered off.

In response to the power down mode, the timing controller provides a control signal to the gate driver, and the gate driver changes the gate driving signals of the entire channels at the same timing. That is, the gate driver outputs the entire gate driving signals at a high or low level.

When the gate driver is operated in response to the power down mode, the gate driver must supply very large charging currents at the same time, in order to drive the display panel. That is, the display panel serves as an overload for the gate driver. When the gate driver supplies excessive currents at the same time in response to the power down mode, the gate driver may be severely heated or internal parts of the gate driver, such as wirings or elements, may be damaged.

SUMMARY

Various embodiments are directed to a technology for preventing the heat generation of a gate driver or the damage of wirings or parts in the gate driver, when the gate driver drives a display panel in response to a power down mode.

Also, various embodiments are directed to a technology for preventing the damage of a gate driver by distributing the timings at which the gate driver provides currents to a display panel, when the gate drivers drives the display panel in response to a power down mode.

Also, various embodiments are directed to a technology for preventing the damage of a gate driver by distributing the timings at which the gate driver provides currents to a display panel, while preventing the degradation of image quality, even though the supply of an external clock signal is stopped as a power down mode is executed.

In an embodiment, a gate driver may include: a gate signal processor receives a gate clock signal and outputs a plurality of gate signals in synchronization with the gate clock signal; a controller receives a power down control signal for controlling a power down mode, and generates a plurality of driving control signals having a difference in activation time therebetween by delaying the power down control signal; and a plurality of output circuits output a plurality of gate driving signals corresponding to the plurality of gate signals to a display panel. The plurality of output circuits output the plurality of gate driving signals to have a level corresponding to the power down mode, in response to the activation times of the plurality of driving control signals, respectively.

In an embodiment, a control method of a gate driver may include: generating a plurality of driving control signals having a difference in activation time therebetween by delaying a power down control signal for controlling a power down mode; and controlling to output a plurality of gate driving signals provided to a display panel using the plurality of driving control signals, such that each or each group of the plurality of gate driving signals has the difference in activation time in response to the power down mode.

In an embodiment, a control method of a gate driver may include: providing a clock signal in synchronization with a power down control signal for controlling a power down mode; generating a plurality of driving control signals having a difference in activation time therebetween in synchronization with the clock signal; and controlling to output a plurality of gate driving signals provided to a display panel using the plurality of driving control signals, such that each or each group of the plurality of gate driving signals has the difference in activation time in response to the power down mode.

DETAILED DESCRIPTION

Figure 1:
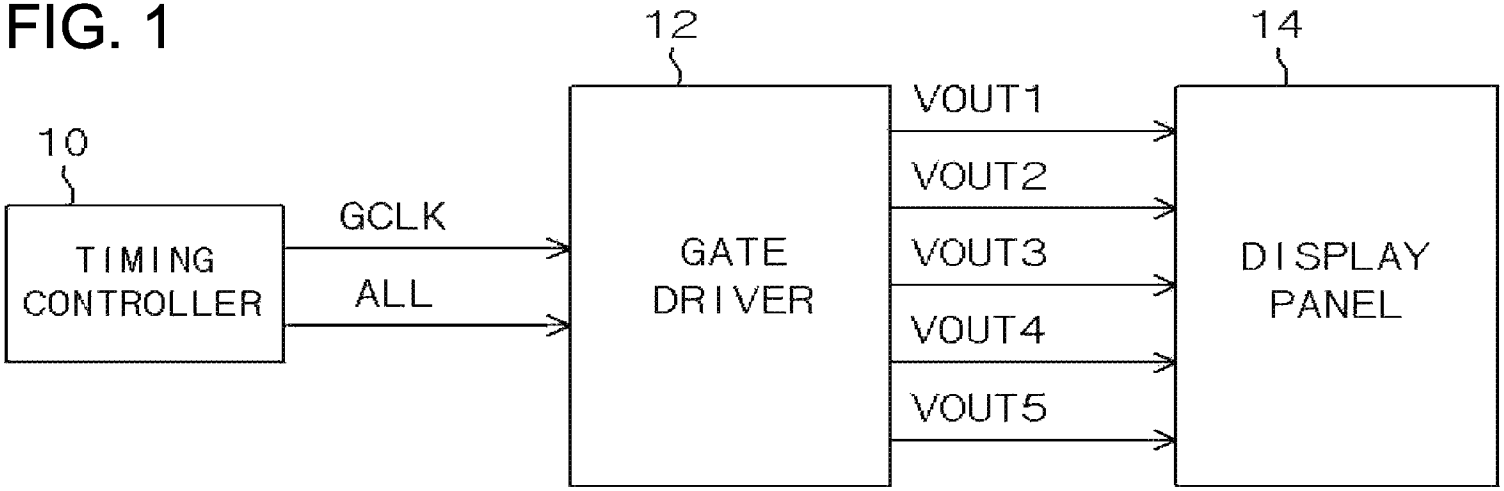
FIG. 1 illustrates a gate driver according to an embodiment of the present invention, and is a block diagram for describing an operation corresponding to a power down mode.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

Referring to FIG. 1, a timing controller 10, a gate driver 12, and a display panel 14 may be provided.

The gate driver 12 according to the embodiment of the preset invention may receive a gate clock signal GCLK and a control signal ALL from the timing controller 10, and provide gate driving signals VOUT1 to VOUT5 to the display panel 14.

The timing controller 10 may provide the control signal ALL and the gate clock signal GCLK for controlling the operation of the gate driver 12.

The control signal ALL may include a gate enable signal for enabling the operation of the gate driver 12 or a control signal for a power down mode. In order to describe the embodiment of the present invention, suppose that the timing controller 10 representatively provides the control signal ALL for the power down mode to the gate driver 12. Hereafter, the control signal ALL for the power down mode will be referred to as a power down control signal.

The gate clock signal GCLK is a basic clock signal which is required when the gate driver 12 generates the gate driving signals VOUT1 to VOUT5 and provides the gate driving signals VOUT1 to VOUT5 to the display panel 14.

In order to display an image of one display panel 14, a plurality of gate drivers 12 may be required. The number of the gate drivers 12 may be set according to the size and resolution of the display panel 14. The gate driver 12 may be configured to provide the plurality of gate driving signals VOUT1 to VOUT5 to gate lines included in a region handled by the gate driver 12 in the display panel 14.

When the plurality of gate drivers 12 are provided, the plurality of gate drivers 12 may be configured to shift the enable signal. Furthermore, the plurality of gate drivers may be sequentially driven. That is, the first gate driver 12 may receive the gate enable signal, and the next gate driver 12 may receive a carry out signal outputted from the previous stage. The carry out signal may play the same role as the gate enable signal.

Furthermore, the power down control signal ALL may be independently provided to the plurality of gate drivers 12. That is, the power down control signal ALL may be transmitted through a transmission line coupled in parallel to the gate drivers 12. Thus, the gate drivers 12 may not sequentially enter the power down mode, but independently enter the power down mode.

In the present embodiment, one gate driver 12 is provided. However, even when a plurality of gate drivers 12 are provided, the above-described configuration may be applied in the same manner. Thus, the descriptions of the embodiment in which the plurality of gate drivers 12 are provided are omitted herein.

The display panel 14 may include various flat display panels such as an LCD panel, an LED display panel, and an OLED display panel.

Furthermore, a display system may include a source driver (not illustrated) and a power supply unit (not illustrated). The source driver may provide a source driving signal, corresponding to data provided from the timing controller 10, to the display panel 14. The power supply unit may provide voltages required for the operations of the timing controller 10, the gate driver 12, and the source driver. Since the embodiment of the present invention discloses a method for controlling the power down mode of the gate driver 12, the detailed illustrations and descriptions of the source driver and the power supply unit are omitted.

When the display panel enters the power down mode and is then turned off, an afterimage of a previously displayed image may be maintained. The power down control signal ALL according to the embodiment of the present invention may serve to improve the quality of an image in response to the power down mode. That is, when the display panel 14 enters the power down mode according to the embodiment of the present invention, the entire screen of the display panel 14 may be temporarily displayed in white or black. As a result, an afterimage may be eliminated.

For the power down mode, the source driver may provide a source driving signal to the display panel 14, in order to temporarily display the entire screen in black or white. In response to this operation, the gate driver 12 may provide the gate driving signals VOUT1 to VOUT5 for turning on the entire pixels of the display panel 14.

That is, the gate driver 12 according to the embodiment of the present invention may receive the power down control signal ALL and output the gate driving signals VOUT1 to VOUT5 at a high or low level (all-high or all-low state).

The gate driver 12 according to the embodiment of the present invention may output the gate driving signals VOUT1 to VOUT5 in the all-high or all-low state such that the gate driving signals VOUT1 to VOUT5 have a difference in activation time therebetween. Specifically, the gate driving signals VOUT1 to VOUT5 may be outputted so that each of the gate driving signals VOUT1 to VOUT5 has a difference in activation time or a part of the gate driving signals VOUT1 to VOUT5 has the same activation time. When a part of the gate driving signals VOUT1 to VOUT5 has the same activation time, the gate driving signals VOUT1 to VOUT5 may be outputted to have activation times which are delayed depending on positions based on a specific position, and gate driving signals having the same activation time may exist. The method for controlling the gate driving signals VOUT1 to VOUT5 to have distributed activation times may be implemented in various manners by a manufacturer. As a result, the load current of the gate driver 12, corresponding to the power down mode, may be distributed to prevent heat generation or element damage.

The gate driving signals VOUT1 to VOUT5 in the all-high state may indicate a gate high voltage, and the gate driving signals VOUT1 to VOUT5 in the all-low state may indicate a gate low voltage. The gate high voltage may be represented as a high-level voltage for turning on a pixel of the display panel 14, and the gate low voltage may be represented as a low-level voltage for turning off a pixel of the display panel 14. The pixel may be changed depending on a method for implementing the display panel 14. In the case of an LCD panel, the pixel may correspond to a thin film transistor for driving liquid crystal. In the case of an LED display panel, the pixel may correspond to an LED. In the case of an OLED display panel, the pixel may correspond to an OLED.

The gate driver 12 for sequentially outputting all or part of the gate driving signals VOUT1 to VOUT5 to have a difference in activation time may be configured to perform analog delay or digital delay.

First, an embodiment of the gate driver 12 to perform analog delay will be described with reference to FIG. 2.

Figure 2:
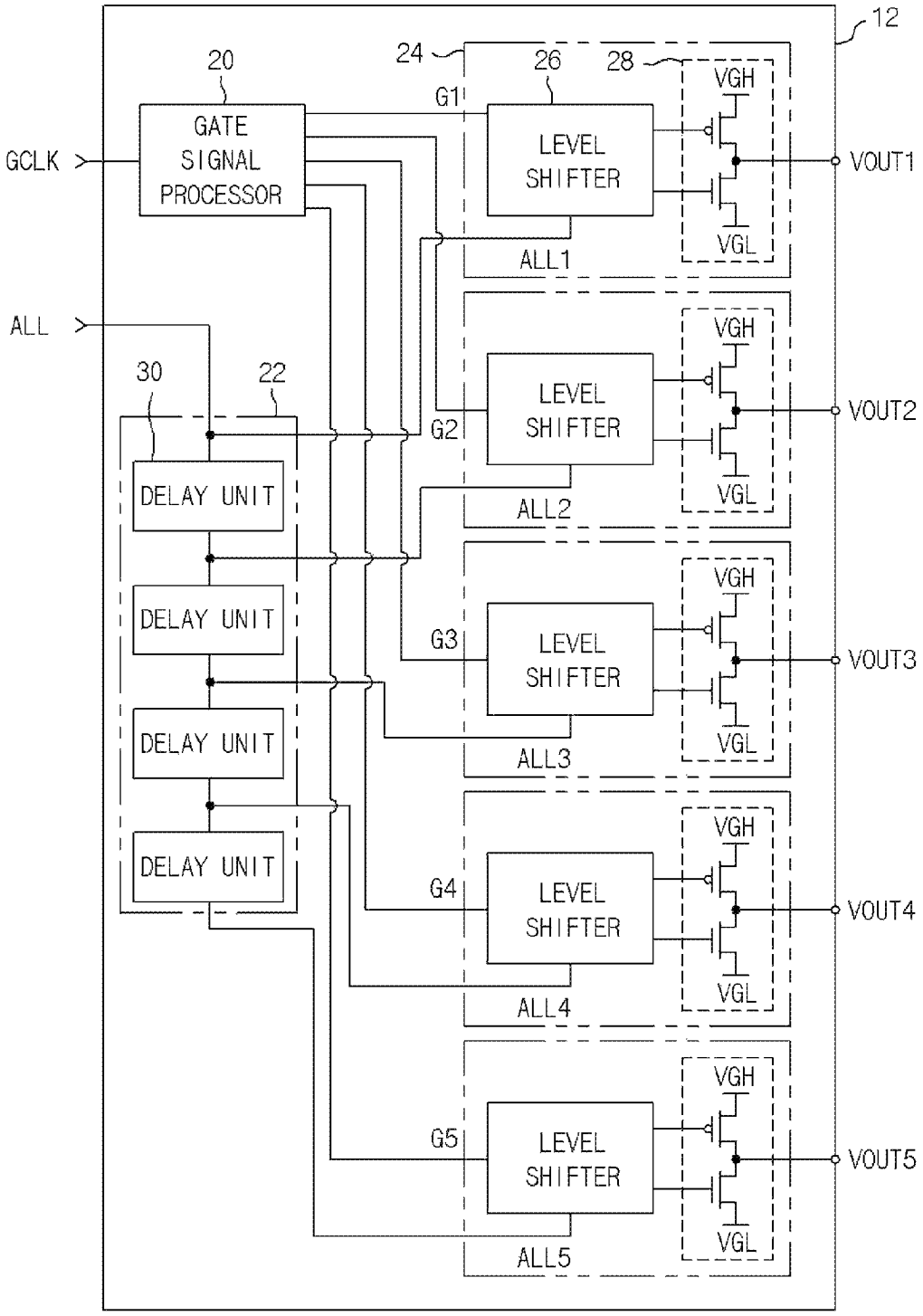
FIG. 2 is a block diagram illustrating the gate driver according to the embodiment of the present invention.

The gate driver 12 of FIG. 2 may include a gate signal processor 20, a controller 22, and five output circuits 24.

The gate signal processor 20 may be configured to receive the gate clock signal GCLK provided from the timing controller 10 and output gate signals G1 to G5. The gate signals G1 to G5 may correspond to the gate driving signals VOUT1 to VOUT5 which the gate driver 12 will provide to the display panel 14. The gate signal processor 20 may include a part to perform a shift operation in synchronization with the gate clock signal GCLK, for example, a shift register. The gate signals G1 to G5 may be synchronized with the gate clock signal GCLK and outputted with activation times which are sequentially shifted. The time during which the gate signals G1 to G5 maintain an active level may be set in consideration of the operation characteristic of the display panel 14.

The controller 22 may receive the power down control signal ALL, and generate driving control signals ALL1 to ALL5 having a difference in activation time, in response to the power down control signal ALL. For this operation, the controller 22 may include four delay units 30 forming a chain. The delay unit 30 may include internal parts which perform asynchronous analog delay using resistor and capacitor components. The four delay units 30 may be designed to have the same delay time.

More specifically, the power down control signal ALL may be inputted to the first delay unit 30 of the controller 22, and a signal outputted from each of the delay units 30 may be transmitted to the delay unit 30 at the next stage. Thus, the controller 22 may generate the driving control signal ALL1 which is obtained by bypassing the power down control signal ALL and the driving control signals ALL2 to ALL5 which are sequentially controlled by the four delay units 30.

The controller 22 may be designed to include five delay units 30, as necessary. Furthermore, the time during which the driving control signals ALL1 to ALL5 maintain an active level may be set to be equal to or more than the minimum time during which an afterimage can be eliminated.

Each of the output circuits 24 may include a level shifter 26 and an output buffer 28, and the number of the output circuits 24 may set to correspond to the number of output channels of the gate driver 12. The output circuits 24 may be configured to receive the gate signals G1 to g5 and the driving control signals ALL1 to ALL5, and output the gate driving signals VOUT1 to VOUT5, respectively.

Hereafter, the configuration of the output circuit 24 to receive the gate signal G1 will be described.

The level shifter 26 may compensate for the level of the gate signal G1 in response to the deactivated driving control signal ALL1, and provide the gate signal G1, of which the level is compensated for, to the output buffer 28. The level shifter 26 may be configured to invert an input. That is, the level shifter 26 may output a low signal in response to the high-level gate signal G1, and output a high signal in response to the low-level gate signal G1.

The level shifter 26 may provide a signal, of which the level is fixed regardless of the state of the gate signal G1, to the output buffer 28 in response to the activated driving control signal ALL1. For example, the level shifter 26 may output a signal fixed to a low level in response to the activated driving control signal ALL1.

The output buffer 28 may include a PMOS transistor and an NMOS transistor of which the drains are commonly coupled to each other. That is, the output buffer 28 may be implemented with a buffer including CMOS transistors. In the output buffer 28, the gate high voltage VGH may be applied to the source of the PMOS transistor, and the gate low voltage VGL may be applied to the source of the NMOS transistor. Furthermore, a node to which the drains of the PMOS and NMOS transistors of the output buffer 28 are commonly coupled may form an output terminal for outputting the gate driving signal VOUT1.

In the above-described structure, the output buffer 28 may output the gate high voltage VGH when a low-level signal is outputted from the level shifter 26, and output the gate low voltage VGL when a high-level signal is outputted from the level shifter 26.

That is, when the driving control signal ALL1 is deactivated, the level shifter 26 may output a pulse signal of which the level transitions in response to the gate signal G1. Then, the output buffer 28 may output the gate driving signal VOUT1 which transitions between the gate high voltage VGH and the gate low voltage VGL in response to the signal outputted from the level shifter 26.

On the other hand, when the driving control signal ALL1 is activated, the level shifter 26 may output a signal fixed to a low level, for example, regardless of the gate signal G1. Then, the output buffer 28 may output the gate high voltage VGH. The gate high voltage VGH of the output buffer 28 may be maintained in response to the time during which the driving control signal ALL1 maintains an active state.

That is, in synchronization with the power down mode, the output circuit 24 may output the gate driving signal VOUT1 to display an all-white or all-block screen for eliminating an image which is currently displayed on the display panel 14. The elimination of the image may be performed during the period in which the driving control signal ALL1 is activated, and the period in which the driving control signal ALL1 is activated may last during several clocks in which power off is performed.

The output circuits 24 receiving the gate signals G2 to G5 and the driving control signals ALL2 to ALL5 may operate in the same manner as the case in which the gate signal G1 and the driving control signal ALL1 are received. However, the gate driving signals VOUT1 to VOUT5 may be outputted with a difference in activation time, which corresponds to the delay of the driving control signals ALL1 to ALL5 provided by the controller 22.

That is, the operation of the gate driver 12 of FIG. 2 will be described with reference to FIG. 3.

In a normal state where an image is displayed on the display panel 14, the power down control signal ALL may maintain a low state. Thus, the controller 22 may output the driving control signals ALL1 to ALL5 in a low state, that is, an inactive state.

In response to the above-described normal state, the gate signal processor 20 may sequentially output the gate driving signals VOUT1 to VOUT5 to the display panel 14.

On the other hand, when the power down control signal ALL is activated as the power down mode is started, the driving control signals ALL1 to ALL5 may be sequentially activated. At this time, the difference in activation time between the respective driving control signals ALL1 to ALL5 may be set by the unit delay time of the delay units 30.

More specifically, the driving control signal ALL1 may be provided for the controller 22 to control the output of the gate driving signal VOUT1 without delaying the power down control signal ALL, and the driving control signals ALL2 to ALL5 may be sequentially delayed by the unit delay time by the controller 22.

As a result, the gate driving signal VOUT1 may transition to a high level in synchronization with the driving control signal ALL1, and the driving control signals ALL2 to ALL5 may be the sequentially delayed and outputted at a high level.

As described above, the embodiments of FIGS. 2 and 3 may provide the gate driving signals VOUT1 to VOUT5 to the display panel 14 at the distributed activation times in response to the power down mode.

Thus, the gate driver 12 may be prevented from supplying excessive currents to the display panel at the same time in response to the power down mode. Since overcurrents may be prevented from flowing at the same time in response to the power down mode, the heat generation or part damage of the gate driver 12 may be prevented.

Figure 3:
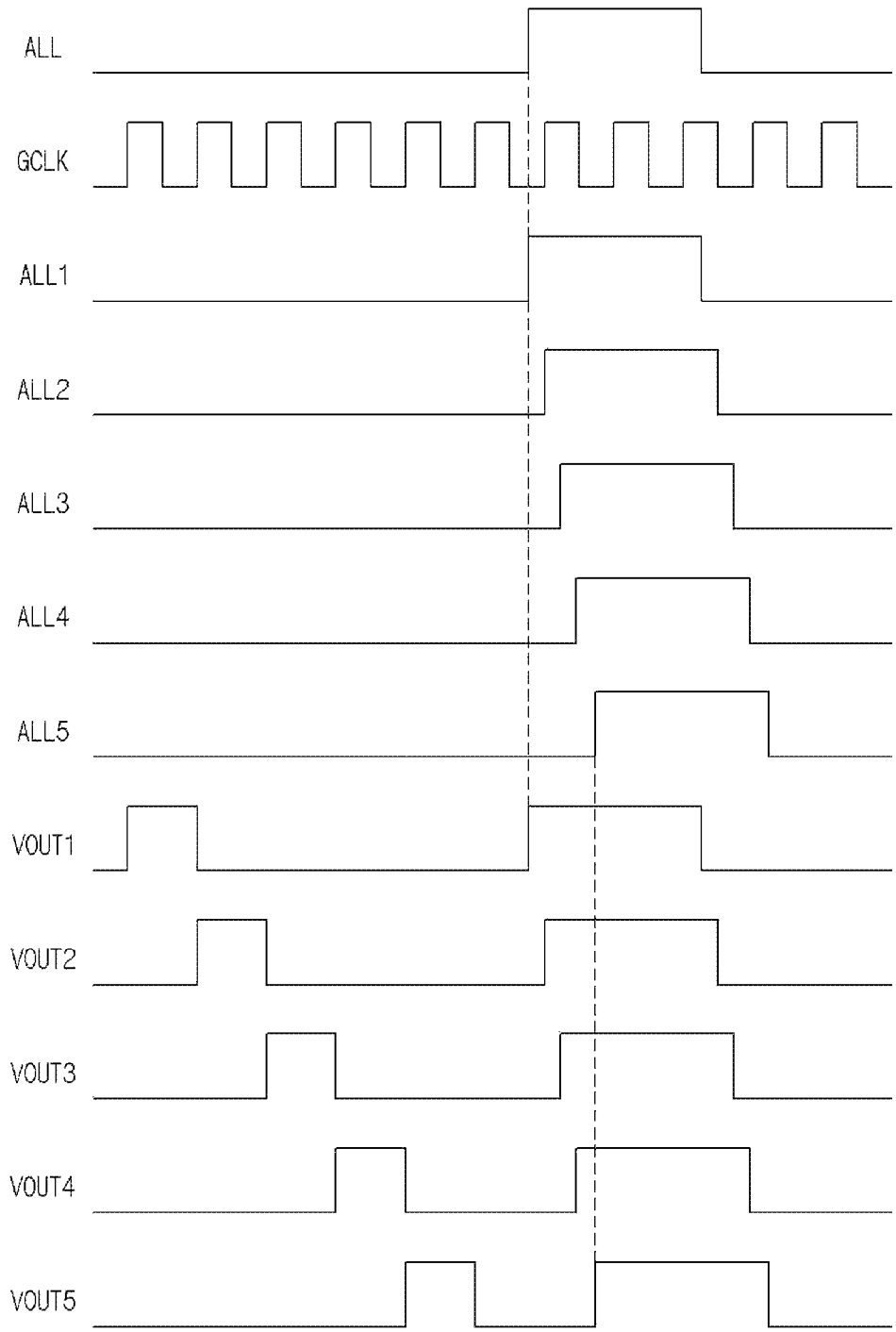
FIG. 3 is a waveform diagram for describing the embodiment of FIG. 2.

FIGS. 2 and 3 illustrate that the gate driving signals VOUT1 to VOUT5 are outputted in the all-high state. However, the present invention is not limited thereto, but the gate driving signals VOUT1 to VOUT5 may be outputted in the all-low state.

Figure 4:
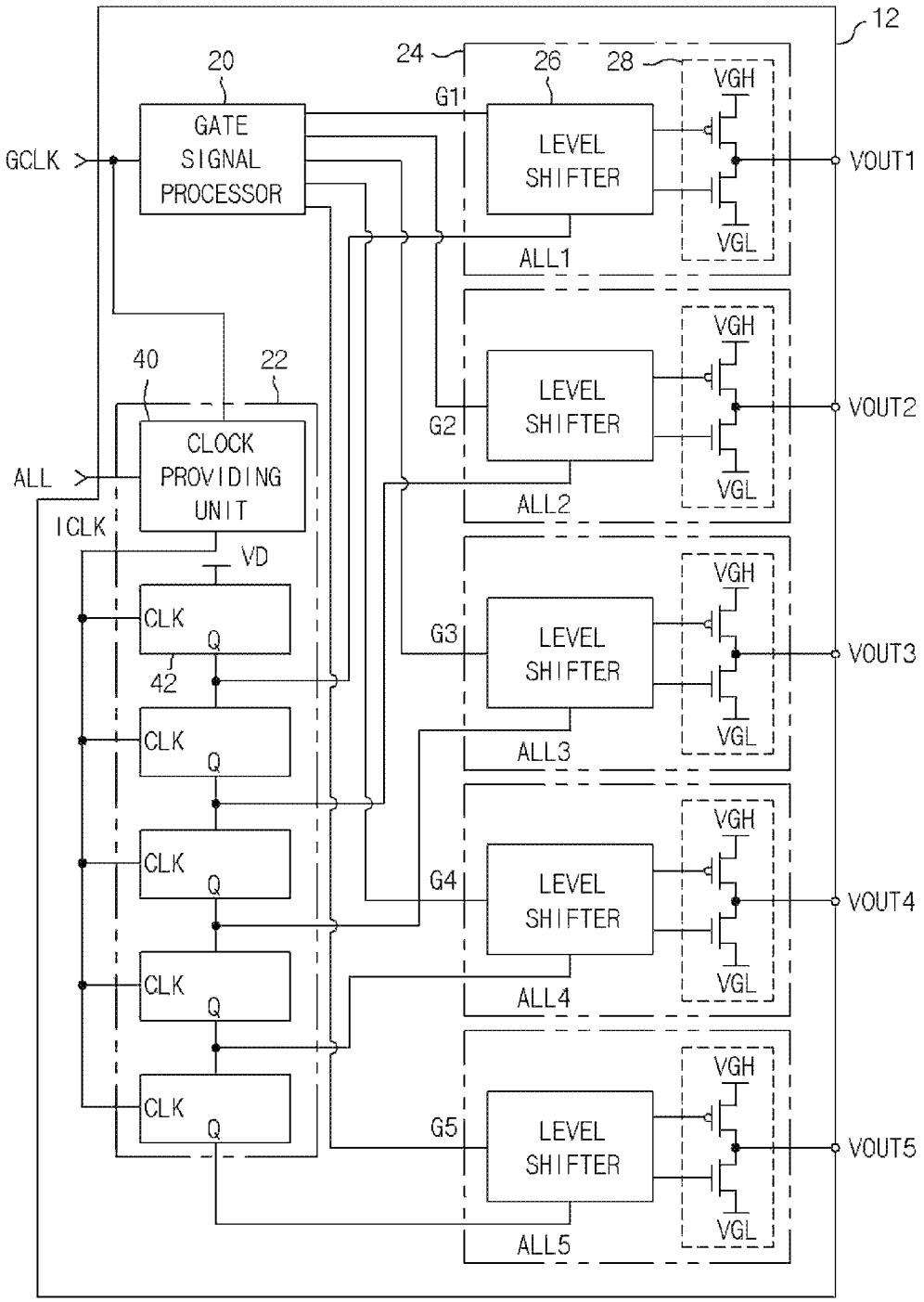
FIG. 4 is a block diagram illustrating a gate driver according to an embodiment of the present invention.

The gate driver 12 according to the embodiment of the present invention may be implemented as illustrated in FIG. 4. The driving control signals ALL1 to ALL5 provided from the controller 22 according to the embodiment of the present invention may be delayed through an external clock signal. The external clock signal may be selected in various manners by a manufacturer. FIG. 4 illustrates that a gate clock signal GCLK is used as the external clock signal.

In the configuration of FIG. 4, the gate signal processor 20 and the output circuits 24 may be configured in the same manner as those of FIG. 2. Thus, the duplicated descriptions for configurations and operations of the same parts are omitted.

The controller 22 of FIG. 4 may include a clock providing unit 40 and a delay circuit.

The clock providing unit 40 may receive the power down control signal ALL, and generate an internal clock signal ICLK in synchronization with activation of the power down control signal ALL. More specifically, the clock providing unit 40 may include a switch which is turned on or off in response to the activated or deactivated power down control signal ALL, and an external clock signal transmitted by the switch may be used as the internal clock signal ICLK.

Furthermore, the delay circuit of FIG. 4 may include five delay units 42 forming a chain. The delay unit 42 may include a delay element such as a latch or shift register. Each of the delay units 42 may have a clock terminal CLK configured to receive the internal clock signal ICLK provided from the clock providing unit 40. Furthermore, the input terminal of the first delay unit 42 may be configured to receive a high-level voltage, and the input terminal of the next delay unit 42 may be configured to receive an output of the previous delay unit 42.

In the above-described configuration of the delay circuit, when a clock signal is provided from the clock providing unit 40, the delay units 42 from the first delay unit 42 to the last delay unit 42 may sequentially output the driving control signals ALL1 to ALL5 in synchronization with the internal clock signal ICLK.

FIG. 4 illustrates the configuration of the delay circuit 42, in which an output of an odd-numbered delay unit 42 is enabled in synchronization with a rising edge of the internal clock signal ICLK applied to the clock terminal CLK thereof, and an output of an even-numbered delay unit 42 is enabled in synchronization with a falling edge of the internal clock signal ICLK applied to the clock terminal CLK thereof.

On the other hand, the delay circuit may be configured in such a manner that an output of an odd-numbered delay unit 42 is enabled in synchronization with a falling edge of the internal clock signal ICLK applied to the clock terminal CLK thereof, and an output of an even-numbered delay unit 42 is enabled in synchronization with a rising edge of the internal clock signal ICLK applied to the clock terminal CLK thereof.

Furthermore, the delay circuit of FIG. 4 may be configured in such a manner that outputs of all the delay units 42 are enabled in synchronization with a rising edge of the internal clock signal ICLK applied to the clock terminal CLK thereof, and outputs of all the delay units 42 are enabled in synchronization with a falling edge of the internal clock ICLK applied to the clock terminal CLK thereof.

That is, FIG. 4 illustrates that the controller 22 is configured to provide the driving control signals ALL1 to ALL5 which are shifted at a half cycle of the gate clock signal GCLK.

Figure 5:
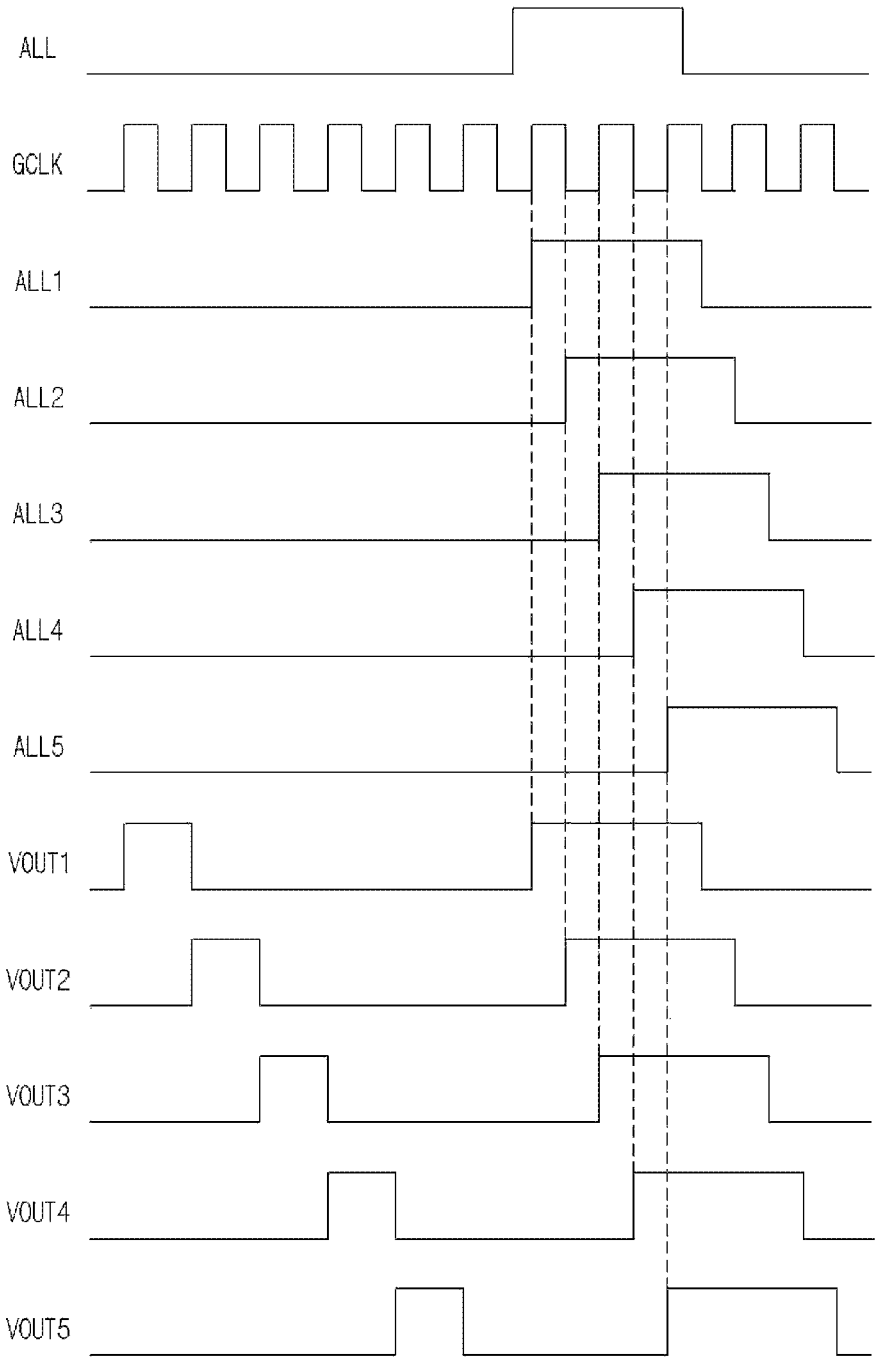
FIGS. 5 and 6 are waveform diagrams for describing the embodiment of FIG. 3.

Thus, referring to FIG. 5, when the power down control signal ALL is activated as the power down mode is started, the driving control signals ALL1 to ALL5 may be sequentially activated at the half cycle of the gate clock signal GCLK.

As a result, the gate driving signal VOUT1 may transition to a high level in synchronization with the driving control signal ALL1, and the driving control signals ALL2 to ALL5 may be sequentially delayed and outputted at a high level.

As described above, the embodiments of FIGS. 4 and 5 may provide the gate driving signals VOUT1 to VOUT5 to the display panel 14 at the distributed activation times in response to the power down mode.

In the embodiments of FIGS. 2 and 4, the controller 22 may output the plurality of driving control signals ALL1 to ALL5 to the plurality of output circuits 24 such that the driving control signals ALL1 to ALL5 have activation times which are sequentially delayed in one direction according to the order in which the gate lines are arranged in the display panel 14.

The present invention is not limited thereto, but the controller 22 may output the plurality of driving control signals ALL1 to ALL5 to the plurality of output circuits 24 such that the driving control signals ALL1 to ALL5 have activation times which are sequentially delayed in various orders.

Figure 6:
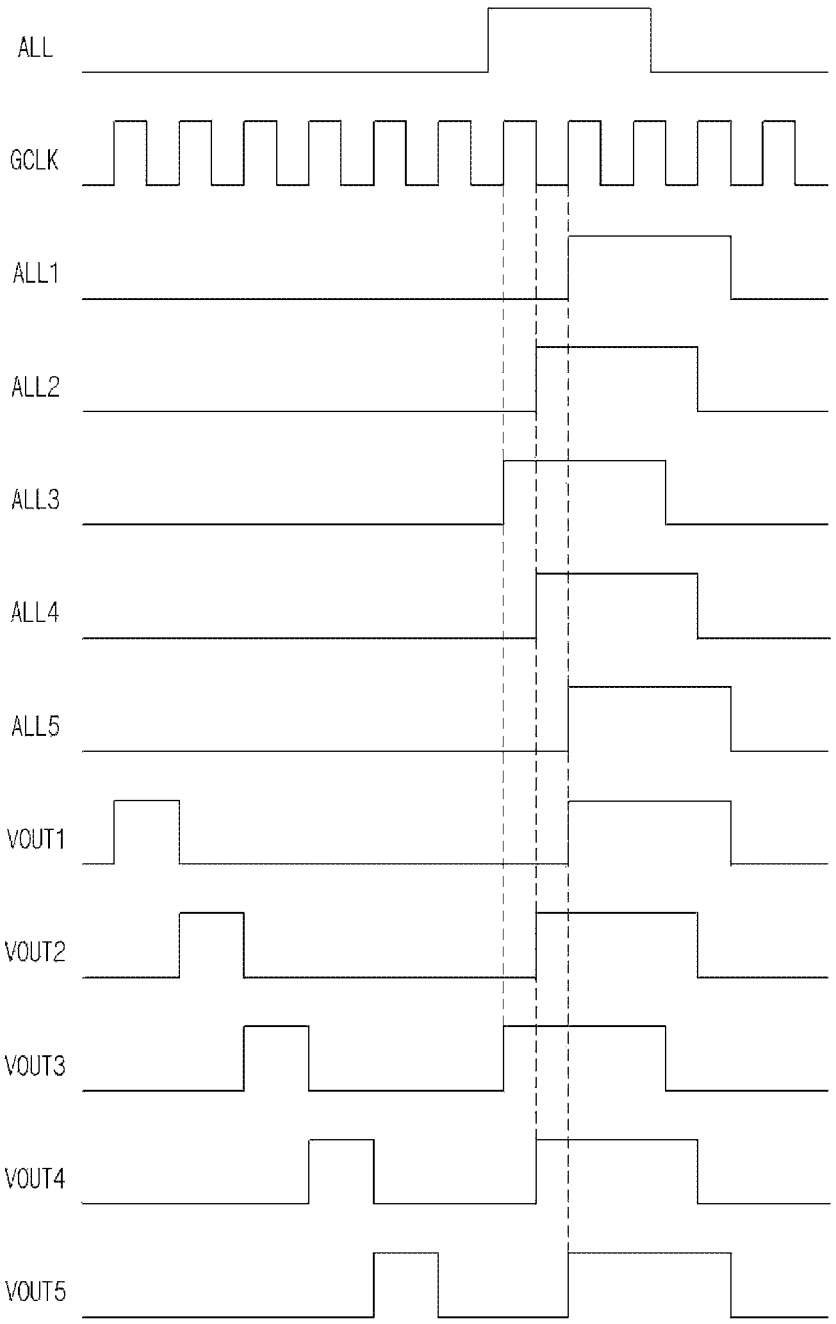

For example, as illustrated in FIG. 6, the controller 22 may provide the driving control signals ALL1, ALL2, ALL4, and ALL5 to the output circuit 24 such that the driving control signals ALL1, ALL2, ALL4, and ALL5 have activation times which are sequentially delayed according to the order in which the driving control signals ALL1, ALL2, ALL4, and ALL5 are adjacent to the driving control signal ALL3. Thus, the output circuit 24 may provide the gate driving signals VOUT1, VOUT2, VOUT4, and VOUT5 to the output circuit 24 such that the gate driving signals VOUT1, VOUT2, VOUT4, and VOUT5 have activation times which are sequentially delayed according to the order in which the gate driving signals VOUT1, VOUT2, VOUT4, and VOUT5 are adjacent to the gate driving signal VOUT3.

As a modification of FIG. 6, the controller 22 may be configured to divide the plurality of output circuits 24 into a plurality of groups, and output the plurality of driving control signals ALL1 to ALL5 to the plurality of output circuits 24 such that each of the groups has the same delay pattern.

Although the supply of the external clock signal such as the gate clock signal GCLK is stopped as the power down mode is executed, the damage of the gate driver 12 needs to be prevented by distributing the timings at which currents are provided to the display panel 14 from the gate driver 12, while preventing the degradation of image quality.

Figure 7:
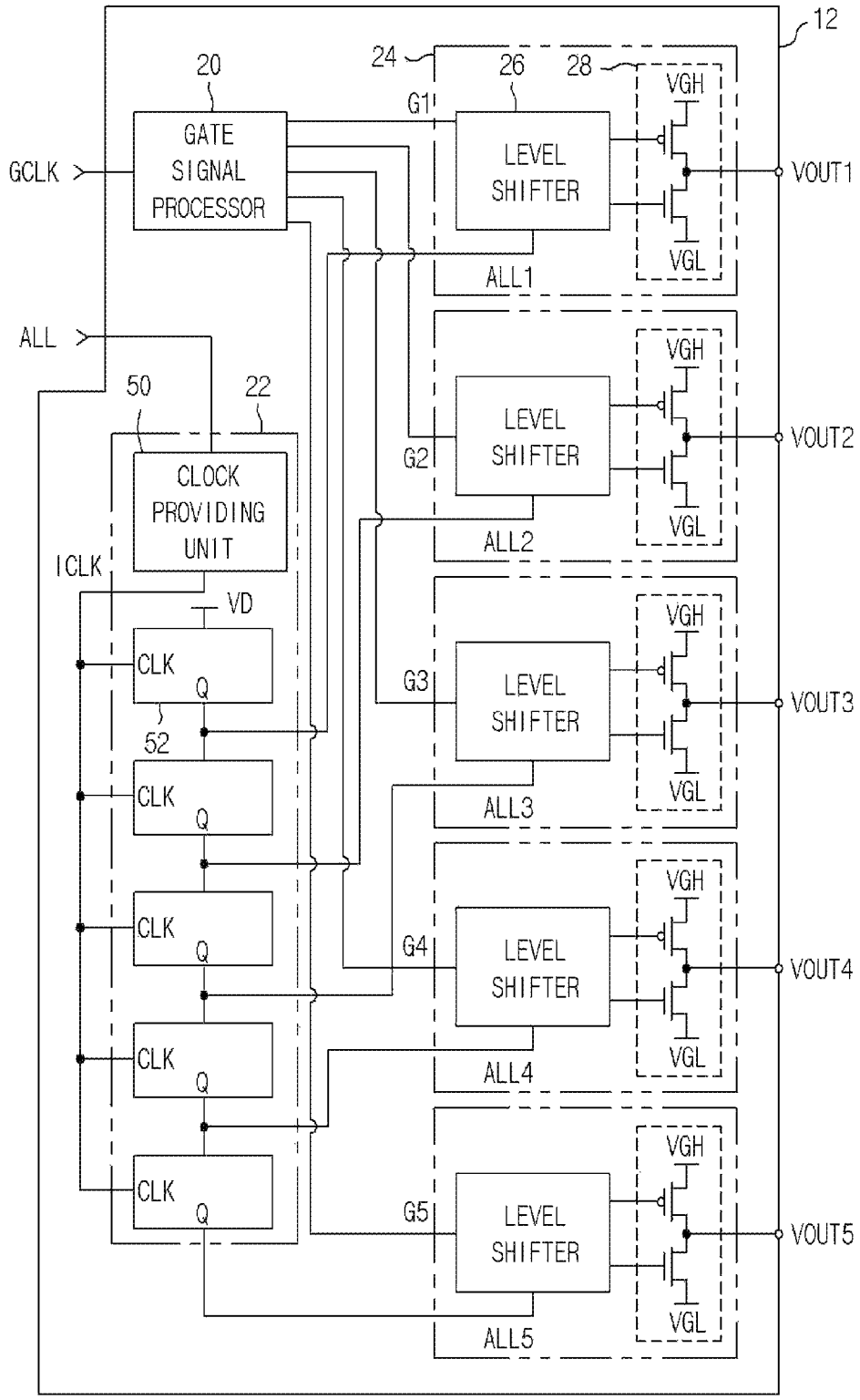
FIG. 7 is a block diagram illustrating the gate driver according to an embodiment of the present invention.

For this operation, the gate driver 12 according to the embodiment of the present invention may be implemented as illustrated in FIG. 7. In the embodiment of the gate driver 12 of FIG. 7, the driving control signals ALL1 to ALL5 provided from the controller 22 may be delayed through the internal clock signal ICLK oscillated therein.

In the configuration of FIG. 7, the gate signal processor 20 and the output circuits 24 may be configured in the same manner as those of FIGS. 2 and 4. Thus, the duplicated descriptions for configurations and operations of the same parts are omitted.

The controller 22 of FIG. 7 may include a clock providing unit 50 and a delay circuit.

The clock providing unit 50 may receive a power down control signal ALL, and generate an internal clock signal ICLK in synchronization with activation of the power down control signal ALL. More specifically, the clock providing unit 50 may include an oscillator, and generate the internal clock signal ICLK through internal oscillation of the oscillator in response to activation of the power down control signal ALL.

Furthermore, the delay circuit of FIG. 7 may include five delay units 52 forming a chain. Since the delay units 52 are configured in the same manner as the delay units 42 of FIG. 4, the duplicated descriptions thereof are omitted.

In the above-described configuration of the delay circuit, when the internal clock signal ICLK is provided from the clock providing unit 50, the delay units 52 from the first delay unit to the last delay unit may sequentially output the driving control signals ALL1 to ALL5 in synchronization with the internal clock signal ICLK.

Although the gate clock signal GCLK is not normally provided in response to the power down mode, the controller 22 of FIG. 7 may sequentially output the driving control signals ALL1 to ALL5 using the internal clock signal ICLK oscillated therein.

More specifically, when receiving the activated power down control signal ALL for controlling the power down mode regardless of whether the external clock signal such as the gate clock signal GCLK is provided, the clock providing unit 50 of the controller 22 may start oscillation in response to the power down control signal ALL, and output the internal clock signal ICLK obtained through the internal oscillation.

The internal clock signal ICLK of the clock providing unit 50 may be provided to each of the delay units 52. As described above with reference to FIG. 4, the delay units 52 from the first delay unit to the last delay unit may sequentially output the driving control signals ALL1 to ALL5 in synchronization with the internal clock signal ICLK.

Figure 8:
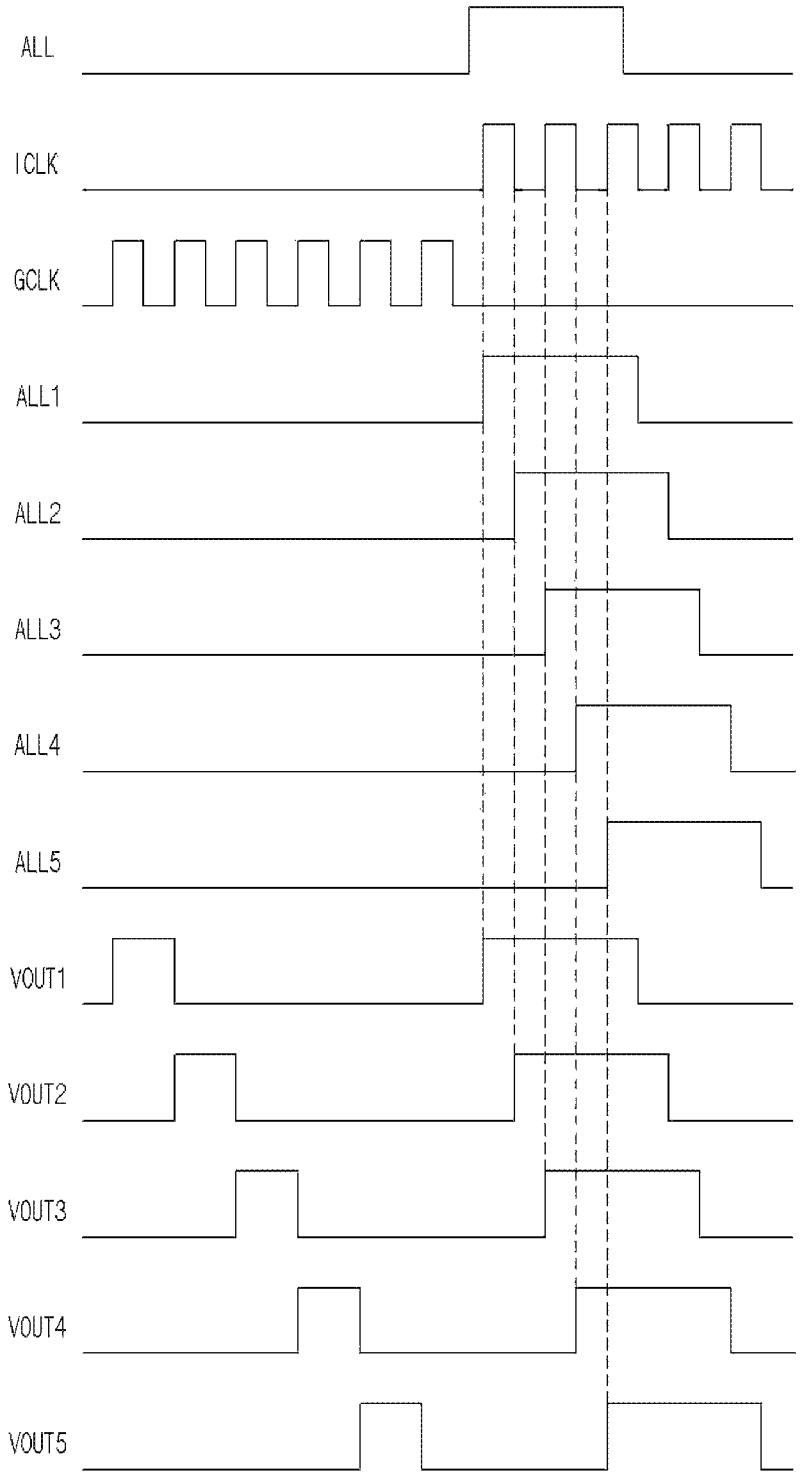
FIGS. 8 and 9 are waveform diagrams for describing the embodiment of FIG. 7.

As a result, in the embodiment of FIG. 7, the gate driving signals VOUT1 to VOUT5 may be sequentially delayed and outputted at a high level in synchronization with the driving control signals ALL1 to ALL5, as illustrated in FIG. 8.

In the embodiment of FIG. 7, the output synchronization time of the delay units 52 may be set in various manners. For reference, FIG. 8 illustrates that the delay units 52 included in the delay circuit are configured in such a manner that an output of an odd-numbered delay unit 52 is enabled in synchronization with a rising edge of the internal clock signal ICLK applied to the clock terminal CLK thereof, and an output of an even-numbered delay unit 52 is enabled in synchronization with a falling edge of the internal clock signal ICLK applied to the clock terminal CLK thereof.

Figure 9:
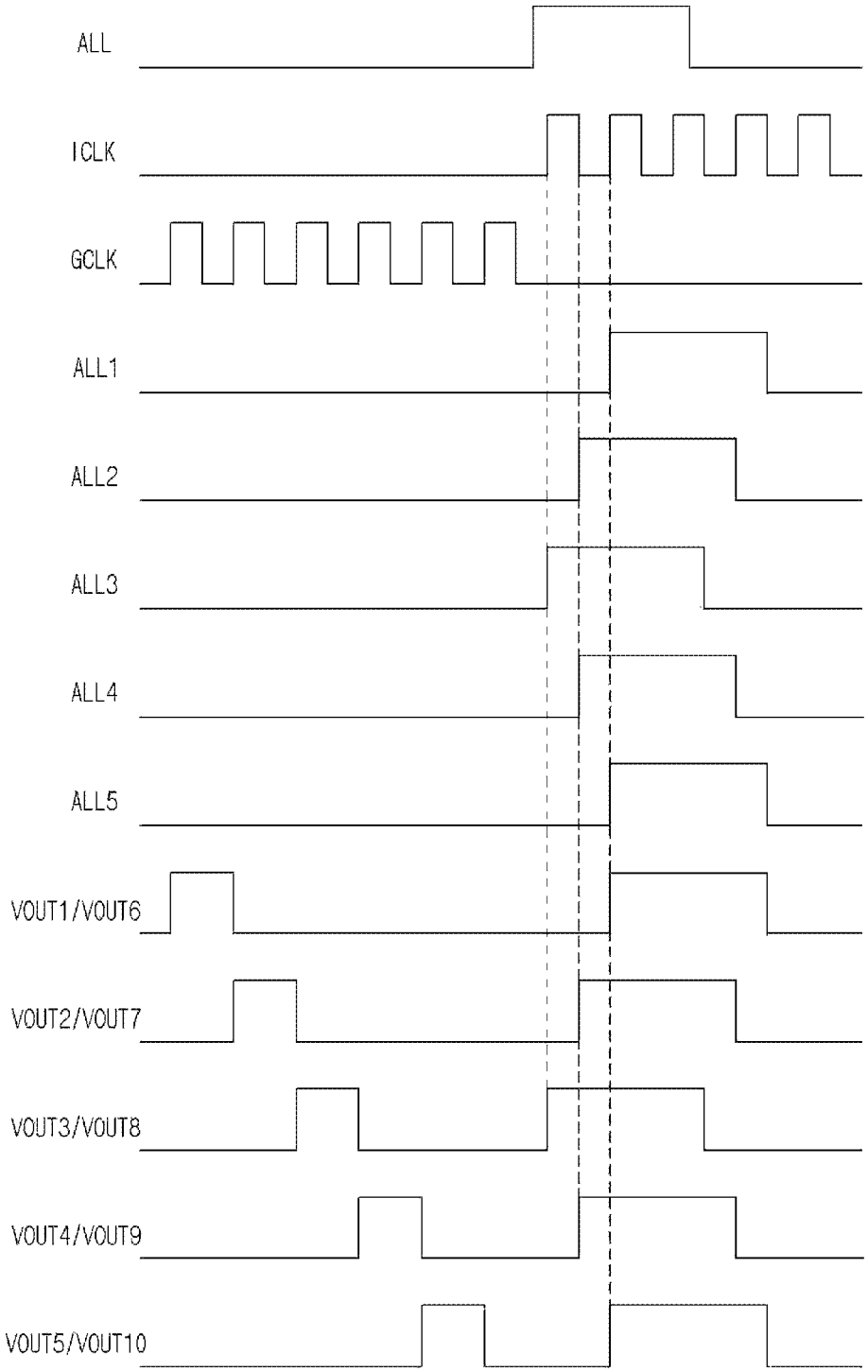

In the embodiment of FIG. 7, the output circuits 24 may be divided into a plurality of groups as illustrated in FIG. 9, and the plurality of driving control signals ALL1 to ALL5 may be outputted to the plurality of output circuits 24 such that each of the groups has the same delay pattern.

FIG. 9 illustrates that the output circuits 24 to output the gate driving signals VOUT1 to VOUT5 and the gate driving signals VOUT6 to VOUT10 are divided into two groups, and the plurality of driving control signals ALL1 to ALL5 are applied so that each of the groups has the same delay pattern.

Thus, even under an environment in which a clock signal for synchronization is not provided from outside in the power down mode as illustrated in FIGS. 7 and 9, the gate driving signals VOUT1 to VOUT5 may be provided to the display panel 14 at the distributed activation times in response to the power down mode.

Therefore, the gate driver 12 may be prevented from supplying excessive currents to the display panel at the same time in response to the power down mode. Since overcurrents may be prevented from flowing at the same time in response to the power down mode, the heat generation or part damage of the gate driver 12 may be prevented.

According to the embodiments of the present invention, it is possible to prevent the heat generation of the gate driver or the damage of wirings or elements in the gate driver which drives the display panel, in response to the power down mode.

Furthermore, it is possible to prevent the damage of the gate driver by distributing the timings at which the gate driver provides currents to the display panel, in response to the power down mode.

Furthermore, although the supply of an external clock signal is stopped, the power down mode may be executed using the internal clock signal oscillated in the gate driver. The damage of the gate driver may be prevented by distributing the timings at which the gate driver provides currents to the display panel, while the degradation of image quality is prevented.

While various embodiments have been described above, it will be understood to those skilled in the art that the embodiments described are by way of example only. Accordingly, the disclosure described herein should not be limited based on the described embodiments.

What is claimed is:

1. A gate driver comprising:

a gate signal processor receives a gate clock signal generated externally and provides gate signals in synchronization with the gate clock signal in a normal state;

a controller receives a power down control signal, generates an internal clock signal in synchronization with activation of the power down control signal when a power down mode is started, and sequentially generates and provides driving control signals having a difference in activation time in synchronization with the internal clock signal in order to distribute output timing of the gate driver when the power down control signal is activated; and a plurality of output circuits output gate driving signals corresponding to the gate signals in the normal state or the driving control signals in the power down mode to a display panel, according to whether the driving control signals are activated, wherein the plurality of output circuits are sequentially activated in response to the driving control signals sequentially provided from the controller when the power down control signal is activated.

2. The gate driver of claim 1, wherein the controller generates the clock signal by internal oscillation when the power down control signal is activated, and controls the driving control signals to be sequentially delayed by a pulse width of the clock signal.

3. The gate driver of claim 1, wherein the plurality of output circuits output the gate driving signals corresponding to the driving control signals to the display panel when the driving control signals are activated.

4. The gate driver of claim 1, wherein the controller comprises:

a clock providing unit generates the internal clock signal in synchronization with activation of the power down control signal; and a delay circuit generates the driving control signals having the difference in activation time in synchronization with the internal clock signal, and provides the driving control signals to the plurality of output circuits.

5. The gate driver of claim 4, wherein the delay circuit comprises a plurality of delay units forming a chain, and the plurality of delay units sequentially delay the drive control signals by a pulse width of the internal clock signal in synchronization with the internal clock signal.

6. The gate driver of claim 1, wherein the controller provides the driving control signals having the difference in activation time to the plurality of output circuits according to an adjacent order based on positions of one or more gate lines arranged in the display panel.

7. The gate driver of claim 1, wherein the plurality of output circuits are divided into a plurality of groups, and wherein the controller provides the driving control signals to the plurality of output circuits so that each of the groups has a same delay pattern.

8. The gate driver of claim 1, wherein each of the plurality of output circuits comprises a level shifter and an output buffer, wherein the level shifter compensates a level of the gate signal in response to deactivation state of the driving control signal and provides the compensated gate signal to the output buffer.

9. The gate driver of claim 8, wherein the level shifter provides a signal with fixed level to the output buffer regardless of a state of the gate signal in response to an activation state of the driving control signal.

10. The gate driver of claim 1, wherein the output buffer outputs a gate high voltage or gate low voltage as the gate driving signal in response to the signal with fixed level.

11. A control method of a gate driver, comprising:

providing gate signals in synchronization with a gate clock signal generated externally in a normal state;

generating an internal clock signal in synchronization with activation of a power down control signal when a power down mode is started, and sequentially generating and providing driving control signals having a difference in activation time in synchronization with the internal clock signal in order to distribute output timing of the gate driver by using a controller when the power down control signal is activated; and controlling to output gate driving signals corresponding to the gate signals in the normal state or the driving control signals a display panel by using a plurality of output circuits, according to whether the driving control signals are activated, wherein the plurality of output circuits are sequentially activated in response to the driving control signals sequentially provided from the controller when the power down control signal is activated.

12. The control method of claim 11, wherein the sequentially providing the driving control signals comprises:

generating the internal clock signal by internal oscillation when the power down control signal is activated, and controlling the driving control signals to be sequentially delayed by a pulse width of the clock signal.

13. The control method of claim 11, wherein controlling to output the gate driving signals comprises outputting the gate driving signals corresponding to the driving control signals to the display panel regardless of state of the gate signals when the driving control signals are activated.

14. The control method of claim 11, wherein controlling to output the gate driving signals comprises outputting the gate driving signals according to an adjacent order based on positions of one or more gate lines arranged in the display panel.

* * * * *